US010688819B2

(12) United States Patent
Montag

(10) Patent No.: US 10,688,819 B2
(45) Date of Patent: Jun. 23, 2020

(54) METHOD AND CONTROLLER FOR SETTING A PROPERTY AND/OR A QUANTITY OF A COATING SUBSTANCE FOR A RECORDING MEDIUM

(71) Applicant: Océ Holding B.V., Venlo (NL)

(72) Inventor: Thomas Montag, Unterhaching (DE)

(73) Assignee: Canon Production Printing Holding B.V., Venlo (NL)

( * ) Notice: Subject to any disclaimer, the term of this patent is extended or adjusted under 35 U.S.C. 154(b) by 0 days.

(21) Appl. No.: 16/265,357

(22) Filed: Feb. 1, 2019

(65) Prior Publication Data

US 2019/0241001 A1 Aug. 8, 2019

(30) Foreign Application Priority Data

Feb. 2, 2018 (DE) ..... 10 2018 102 332

(51) Int. Cl.

| | |
|---|---|
| ***B41J 29/393*** | (2006.01) |
| ***B41J 11/00*** | (2006.01) |
| ***B05C 5/02*** | (2006.01) |
| ***B41J 2/21*** | (2006.01) |
| ***B41M 5/00*** | (2006.01) |

(52) U.S. Cl.

CPC ..... *B41J 29/393* (2013.01); *B05C 5/0212* (2013.01); *B41J 2/2114* (2013.01); *B41J 11/0015* (2013.01); *B41M 5/0017* (2013.01)

(58) Field of Classification Search

CPC .... B41J 29/393; B41J 2/2114; B41J 11/0015; B41M 5/0011; B41M 5/0017; B41M 5/0029

See application file for complete search history.

(56) References Cited

U.S. PATENT DOCUMENTS

| | | | | |
|---|---|---|---|---|
| 6,132,021 | A * | 10/2000 | Smith | B41J 2/2114 347/101 |
| 2009/0153613 | A1 | 6/2009 | Yamanobe | |
| 2014/0071196 | A1 | 3/2014 | Hihara et al. | |
| 2014/0204158 | A1 | 7/2014 | Emamjomeh et al. | |
| 2016/0259289 | A1 | 9/2016 | Gerlach et al. | |
| 2017/0008313 | A1 | 1/2017 | Yamazaki et al. | |
| 2017/0246885 | A1* | 8/2017 | Katagami | B41J 11/0015 |

FOREIGN PATENT DOCUMENTS

DE 102015103100 B3 12/2015

OTHER PUBLICATIONS

Foreign action dated Oct. 26, 2018 in application No. 10 2018 102 332.4.

* cited by examiner

*Primary Examiner* — Julian D Huffman

(74) *Attorney, Agent, or Firm* — Schiff Hardin LLP

(57) ABSTRACT

In a printing method, a coating substance is applied onto the recording medium depending on spatially resolved temperature data with regard to the temperature of the surface of a recording medium to be printed to in preparation for printing of a print image. The quality of the print image may thus be increased, in particular given the presence of an inhomogeneous curve of the temperature of the recording medium.

15 Claims, 2 Drawing Sheets

METHOD AND CONTROLLER FOR SETTING A PROPERTY AND/OR A QUANTITY OF A COATING SUBSTANCE FOR A RECORDING MEDIUM

CROSS REFERENCE TO RELATED APPLICATIONS

This patent application claims priority to German Patent Application No. 102018102332.4, filed Feb. 2, 2018, which is incorporated herein by reference in its entirety.

BACKGROUND

The disclosure relates to a method and a controller with which a property and/or the quantity of a coating substance, in particular a primer, for coating of a recording medium in preparation for printing to the recording medium may be adjusted in order to increase the print quality.

In a printing device, in particular in an inkjet printing device, the travel and/or the penetration of electrostatically stabilized dispersed pigments (for example from the ink used) should be prevented in order to achieve an optimally high color print quality on a recording medium. For this purpose, a recording medium may be coated with a coating substance before the application of ink, wherein the coating substance typically comprises salts. The coating substance weakens the electrostatic stabilization of the pigments such that pigments or particulate components in the ink that is used agglomerate. As a result of this, the travel of ink on the recording medium, and the penetration of ink in the recording medium, are reduced. The coating substance is typically applied onto the recording medium in liquid form, in particular in an aqueous solution.

The application of a liquid coating substance may lead to the situation that the recording medium becomes rippled, and/or that expansion properties and/or dimensions of the recording medium alter. This may in turn lead to negative effects on a print image printed on the recording medium. Furthermore, the application of too high a quantity of coating substance may lead to too strong an agglomeration of pigments, and therefore to a rigidity of a printed print image. On the other hand, the application of too small a quantity of coating substance typically leads to a travel of the ink of a printed print image.

DE 10 2015 103 100 B3 describes a method in which a property and/or a quantity of a coating substance applied on a recording medium is adapted depending on sensor data with regard to a printed print image in order to increase the print quality.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1:
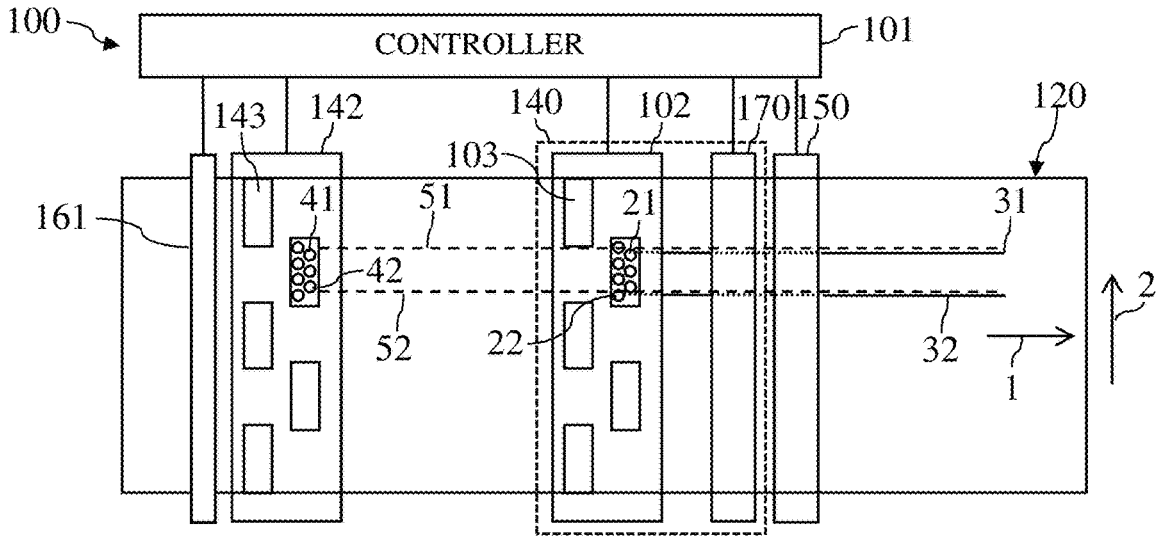
Figure 2A:
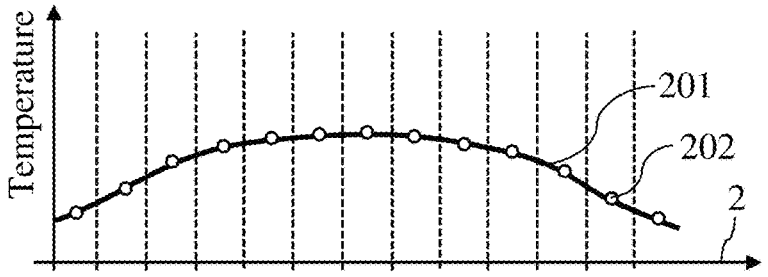
Figure 2B:
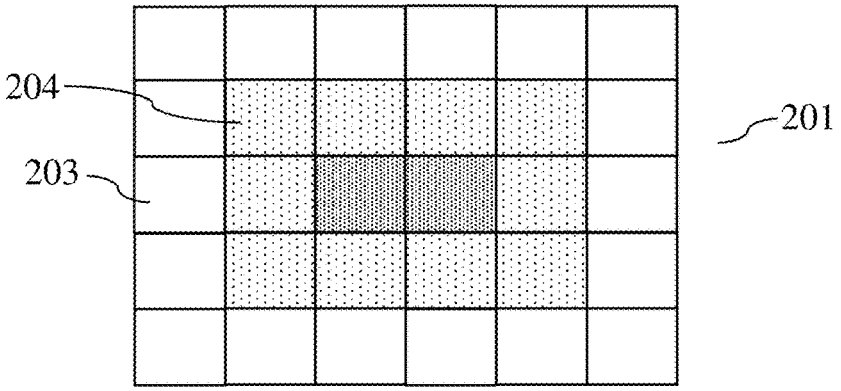
Figure 3:
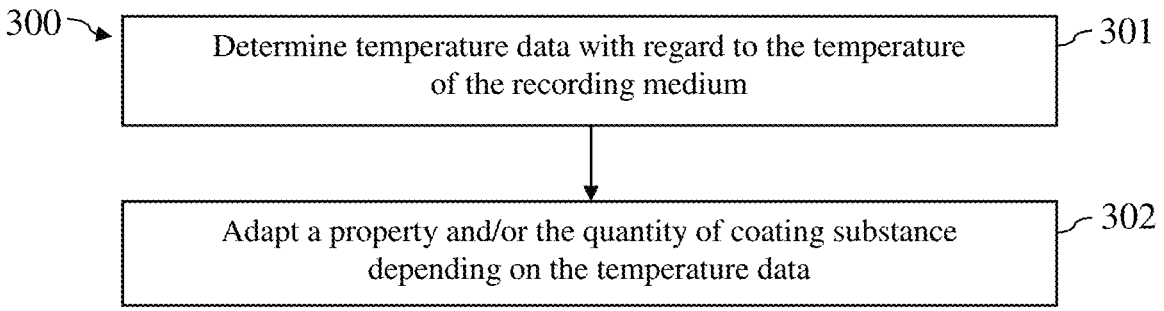

FIG. 1 illustrates a block diagram of an inkjet printing device according to an exemplary embodiment of the present disclosure;

FIG. 2*a* illustrates a plot of a curve of the temperature of a recording medium along the width of the recording medium according to an exemplary embodiment of the present disclosure;

FIG. 2*b* illustrates an example of a temperature distribution along the surface of a recording medium according to an exemplary embodiment of the present disclosure; and FIG. 3 illustrates a flowchart of a method for setting a property and/or the quantity of a coating substance according to an exemplary embodiment of the present disclosure.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the present disclosure is to set a property and/or a quantity of the coating substance applied on a recording medium such that the print quality of a print image is further improved.

According to one aspect of the disclosure, a method is described for setting a property and/or a quantity of coating substance which is applied on a recording medium during a printing process in preparation for printing a print image. The method can include the determination of (typically spatially resolved) temperature data with regard to a temperature of the recording medium. Moreover, the method can include the setting of a property and/or the quantity of the coating substance that is applied onto the recording medium, which setting is dependent on the temperature data.

According to a further aspect of the disclosure, a controller is described for a printing device (e.g. printer). The printing device can include a coater that is configured to apply a coating substance onto the recording medium in preparation for the printing of a print image onto a recording medium. The controller can be configured to determine temperature data (typically spatially resolved temperature data) with regard to a temperature of the recording medium. Moreover, the controller can be configured to determine a property and/or the quantity of the coating substance depending on the temperature data. The controller can also be configured to induce the coating substance to apply coating substance on the recording medium with the determined property and/or in the determined quantity.

FIG. 1 illustrates a printing device (e.g. printer) 100 according to an exemplary embodiment of the present disclosure. The printing device 100 can be configured to print to a recording medium 120 in the form of a web (also referred to as a "continuous feed," since the recording medium 120 is supplied continuously, for example from a roll, to the printing device 100). The recording medium 120 may be produced from, for example, paper, paperboard, cardboard, metal, plastic, textiles, a combination thereof, and/or other materials that are suitable and can be printed to. The recording medium 120 is typically taken off a roll (the takeoff) and then supplied to the print group 140 of the printing device 100. A print image is applied onto the recording medium 120 by the print group 140, and the recording medium 120 that has been printed to is taken up again (possibly after fixing/drying of the print image) onto an additional roll (the takeup). Alternatively, the recording medium 120 that has been printed to may be cut into sheets or single pages by a cutting device. Furthermore, the back side of the recording medium 120 may possibly be printed to in an additional print group 140. In FIG. 1, the transport direction of the recording medium 120 is represented by an arrow 1. The statements in this document are also applicable to a printing device 100 for printing to recording media 120 in the form of sheets or pages or plates.

With continued reference to FIG. 1, the print group 140 of the printing device 100 comprises a print bar 102 that may be used for printing with ink of a defined color (for example black, cyan, magenta and/or yellow, and possibly magnetic ink character recognition (MICR) ink). A print group 140 may comprise a plurality of print bars 102 for printing with respective different inks. Furthermore, the print group 140 may comprise at least one fixer 170 that is configured to fix a print image printed onto the recording medium 120. If applicable, a fixer 170 may be arranged after each print bar 102 in order to at least partially fix the print image applied by the respective print bar 102.

A print bar 102 may comprise one or more print heads 103 that are possibly arranged side by side in multiple rows in order to print the dots of different columns 31, 32 of a print image onto the recording medium 120. In the example depicted in FIG. 1, a print bar 102 comprises five print heads 103, wherein each print head 103 prints the dots of one group of columns 31, 32 of a print image onto the recording medium 120.

In the embodiment illustrated in FIG. 1, each print head 103 of the print group 140 comprises a plurality of nozzles 21, 22, wherein each nozzle 21, 22 is configured to fire or push ink droplets onto the recording medium 120. For example, a print head 103 may comprise multiple thousands of effectively utilized nozzles 21, 22 that are arranged along one or more rows transversal to the transport direction 1 of the recording medium 120. The nozzles 21, 22 in the individual rows may be arranged offset from one another. Dots of a line of a print image may be printed on the recording medium 120, transversal to the transport direction 1 (meaning along the width of the recording medium 120), by means of the nozzles 21, 22 of a print head 103 of the print group 140.

In an exemplary embodiment, the printing device 100 includes a controller 101 (for example an activation hardware and/or control circuitry) that is configured to activate the actuators of the individual nozzles 21, 22 of the individual print heads 103 of the print group 140 in order to apply the print image onto the recording medium 120, depending on print data. The controller 101 may also be configured to activate or otherwise control one or more other components of the printing device 100, for example a coater 142 and/or a sensor and/or the fixer 170. In an exemplary embodiment, the controller 101 includes processor circuitry that is configured to activate one or more actuators and/or control one or more components of the printing device 100.

The print group 140 of the printing device 100 thus comprises at least one print bar 102 having K nozzles 21, 22 that may be activated with a line signal, depending on the transport velocity and the print resolution, in order to print a line (transversal to the transport direction 1 of the recording medium 120) with K pixels or K columns 31, 32 of a print image onto the recording medium 120. The nozzles 21, 22 may be distributed among one or more print heads 103. In the presented example, the one or more print heads 103 are installed immobile or fixed in the printing device 100, and the recording medium 120 is directed past the stationary nozzles 21, 22 at a defined transport velocity. Alternatively or additionally, the one or more print heads 103 may be moved across the recording medium 120 (for example transversal to the transport direction 1 of the recording medium 120).

Furthermore, in an exemplary embodiment, the printing device 100 comprises a coater 142 that is designed corresponding to a print bar 102 for ink. In particular, in an exemplary embodiment, a print bar 102 having one or more print heads 103 may be used as a coater 142. As shown in FIG. 1, the coater 142 comprises a plurality of coating substance print heads 143 arranged offset to one another, respectively having one or more coating substance nozzles 41, 42. The above statements regarding a print bar 102, a print head 103, and a nozzle 21, 22 may be correspondingly applied to the coater 142, a coating substance print head 143, and a coating substance nozzle 41, 42.

Each coating substance nozzle 41, 42 may be configured to fire droplets of coating substance onto the recording medium 120. A coating image made of coating substance may thus be printed onto the recording medium 120. If applicable, precisely one corresponding column 51, 52 of the coating image may thereby be applied onto the recording medium 120 by each coating substance nozzle 41, 42.

Advantageously, via a coating substance, in particular a primer, it may be produced that a "merging" of different inks, for example different inks from different print bars 102, may be reduced. Such a "merging" is often referred to as a bleeding effect. The effectiveness with which the bleeding effect may be avoided thereby typically depends on the quantity and/or a property (for example a composition) of the coating substance that is applied onto a recording medium 120 before the printing.

In an exemplary embodiment, the coating substance applied in the coater 142 includes one or more salts dissolved in water, but is not limited thereto. The agglomerating effect is thereby produced by the salts (i.e. by the active substance of the coating substance). The water (i.e. the solvent) typically serves only to make it possible to apply the active substance (i.e. the salts) as uniformly as possible onto a recording medium 120. Other solvents and/or active substances of the coating substance are possible for one or more aspects of the disclosure as would be understood by those of ordinary skill in the art.

In an exemplary embodiment, the printing device 100 includes a sensor 150 that is configured to detect sensor data with regard to a print image printed by the printing device 100. In an exemplary embodiment, the sensor includes an image camera with which image data with regard to the print image may be optically detected. Other types of sensors are applicable to one or more aspects of the disclosure as would be understood by those of ordinary skill in the art.

In an exemplary embodiment, the temperature with which a recording medium 120 is introduced into a printing device 100 may vary. For example, it may occur that a recording medium 120, for example a plate of corrugated paperboard, is printed to in a printing device 100 (possibly directly) following the manufacturing of the recording medium 120. As a result of this, the recording medium 120 may still exhibit a relatively high temperature (for example 50° C. or more). The recording medium 120 may exhibit a relatively high temperature, in particular in the middle of a sheet. The temperature at the edge may thereby be lower (for example by approximately 20° C. to 25° C.) than in the middle of the recording medium 120. The recording medium 120 may thus exhibit a temperature gradient along the surface of said recording medium 120. The temperature gradient may, for example, arise as a result of an intermediate storage of the recording medium 120 following a manufacturing of the recording medium 120. Alternatively or additionally, upon being supplied into a printing device 100, the recording medium 120 may exhibit a temperature that is substantially higher than the ambient temperature of the printing device 100. The recording medium 120 may then (possibly additionally) cool off during a printing process, and as a result of this may exhibit an inhomogeneous temperature distribution and/or a temperature gradient within the printing device 100. In particular, due to the cooling the temperature of a recording medium 120 may be lower at the outer edges than in the middle of said recording medium 120. Furthermore, the moisture of the recording medium 120 may also rise from the edges toward the middle. An inhomogeneous distribution of the temperature and/or moisture may be present in particular for relatively thick recording media (for example having a thickness of 5 mm, 10 mm or more).

The penetration behavior (in particular the penetration time or the penetration speed) of a recording medium 120 with regard to fluids, for example with regard to the coating substance, typically changes at different temperatures. Alternatively or additionally, the viscosity and therefore the propagation behavior of the coating substance may vary with increasing temperature of the recording medium 120 such that the propagation of the coating substance is reduced. This may be produced in that water fractions and liquid fractions of the coating substance evaporate more quickly due to the increased temperature, such that the viscosity of the remaining components of the coating substance increases.

An inhomogeneous temperature distribution of the recording medium 120 may consequently lead to an inhomogeneous distribution of coating substance on the surface of the recording medium 120. In particular, a relatively high temperature (for example in the middle) of the recording medium 120 may lead to the situation that the coating substance dries relatively quickly, and thus still produces an agglomeration of pigments only to a reduced extent upon subsequent application of ink. Furthermore, the relatively high temperature may lead to the situation that a relatively high proportion of the solvent evaporates from the coating substance, such that the recording medium 120 exhibits a higher absorption capability for solvent of the ink upon subsequent application of said ink. On the other hand, a relatively low temperature (for example at the edges) of the recording medium 120 may lead to the situation that the coating substance dries relatively slowly, and thus may continue to react with the pigments upon subsequent application of ink. Furthermore, the relatively low temperature may lead to the situation that a relatively small proportion of the solvent evaporates from the coating substance, such that the recording medium 120 exhibits a relatively poor absorption capability for solvent of the ink upon subsequent application of said ink. An inhomogeneous temperature distribution of the recording medium 120 may thus result in an inhomogeneous print quality. In particular, a blurring of ink may occur in partial regions or segments of the recording medium 120, and/or to streaking in other partial regions or segments.

One possibility for increasing the print quality is to acclimate the recording medium 120 before printing, such that the recording medium 120 exhibits the ambient temperature of the printing device 100 before printing. However, such an acclimation of the recording medium 120 leads to an increased cost and to an extended printing process.

In an exemplary embodiment, the printing device 100 depicted in FIG. 1 has a temperature sensor 161 that is configured to detect temperature data in relation to a temperature of the recording medium 120 at the input of the print group 140. In particular, the temperature data may indicate a distribution 201 of the temperature of the recording medium 120 in the width direction (represented by arrow 2), meaning along the print width of the recording medium 120 (see FIG. 2*a*). For example, temperature measurement values 202 with regard to the temperature of the recording medium 120 may be detected with a specific spatial resolution (for example 1 inch). As depicted in FIG. 2*a*, due to the inhomogeneous cooling, the temperature of the recording medium 120 may be relatively low at the edges of the recording medium 120 and relatively high in the middle.

In an exemplary embodiment, a property and/or the quantity of the coating substance may then be adapted or set (e.g. by the controller 101) within the coater 142 depending on the temperature data. In particular, a property and/or the quantity of the coating substance that is applied in a defined areal segment of the recording medium 120 may be set or adapted for this areal segment depending on the temperature data.

In one example, temperature measurement values 202 along the width of the recording medium 120, meaning in the width direction 2, may be continuously or repeatedly detected. Furthermore, characteristic data may be provided, for example, in the form of a look-up table, that indicate the penetration times of the coating substance at different temperatures of the recording medium 120. Alternatively or additionally, characteristic data may be provided, for example in the form of a look-up table, that indicate the drying times of coating substance at different temperatures of the recording medium 120. Speed information with regard to a process speed and/or print speed and/or a transport velocity may also be determined.

The characteristic data for different types of recording media 120 may be provided. The respective relevant penetration times of the coating substance may thus be specified for different types of recording media 120, as a function of temperature. Within the scope of a printing process, the type of the recording medium 120 to be printed to may then be determined, and based on that the respective relevant characteristic data may be determined.

In an exemplary embodiment, the temperature data is detected immediately before the printing process, over the entire print width on the recording medium 120, in order to detect a temperature profile or a spatial curve 201 of the temperature. The spatial separation of the temperature measurements may thereby be 1 inch or 3 cm or less. Such a curve 201 of the temperature may be detected repeatedly for different lines (for example with a spacing of 1 inch or 3 cm or less in the transport direction 1). Temperature measurement values 202 may thus be detected for different areal segments of the recording medium 120 (for example segments having a size of 9 $cm^2$ or less). The spatial resolution of the temperature measurement values 202 may thereby be variably adapted over the area of the recording medium 120. In particular, a higher spatial resolution may possibly be chosen at the edges of the recording medium 120. The areal segments for the temperature measurement values 202 may thus be of equal size, at least in part, or vary at least in part over the area of the recording medium 120.

For each areal segment, the expected penetration time and/or the optimal quantity or composition of the coating substance may be determined from the characteristic data depending on the respective temperature measurement value 202. The coater 142 may then be activated (e.g. by the controller 101) in order to apply coating substance with the determined composition and/or in the determined quantity onto the respective areal segment.

The characteristic data for the drying times, the penetration times, and/or the composition or quantity of coating substance may depend on the process speed or print speed of the printing device 100. The composition and/or quantity of the coating substance to be applied may thus also be set depending on the process speed or print speed of the printing device 100.

FIG. 3 shows a flowchart of a method 300 for setting a property and/or a quantity of coating substance according to an exemplary embodiment. The coating substance may be applied during a printing process in preparation for the printing of a print image onto a recording medium 120. In particular, in a printing device 100 coating substance may be applied onto the recording medium 120 by a coater 142. A print image may subsequently be printed onto the coated recording medium 120 in a print group 140, for example by one or more print heads 103.

The coating substance may comprise at least one active substance (for example a salt, for instance a metal salt) that is dissolved in a solvent (for example water). The quantity of a defined coating substance may be set within the scope of the method 300. The defined coating substance may thereby have a predetermined or defined composition. For example, the defined coating substance may have at least one defined active substance that is dissolved in a defined or predetermined concentration in a defined solvent. Alternatively or additionally, a property and/or a composition of the coating substance may be set within the scope of the method 300. An active substance of the coating substance may thereby be varied, and/or the concentration of an active substance may be varied, and/or the composition of a solvent may be varied.

In an exemplary embodiment, the setting of a property and/or the quantity of the coating substance may take place with a defined spatial resolution. The resolution thereby typically coincides with the design of the coater 142. For example, the quantity of applied coating substance may be varied or set per dot with the coater 142 described in conjunction with FIG. 1. In general, a coater 142 may be provided with which a property and/or the quantity of coating substance that is to be applied within different coating segments of the recording medium 120 may be set. A coating segment may thereby comprise one or more dots in the width direction 2 and/or one or more dots in the transport direction 1. For example, a coating segment may have an extent of 1 inch or less in the width direction 2 and/or in the transport direction 1.

In an exemplary embodiment, the method 300 includes the determination 301 of temperature data with regard to a temperature of the recording medium 120. The temperature data may be detected by means of a temperature sensor 161. The temperature sensor 161 may have a defined spatial resolution, meaning that the temperature data may be spatially resolved. The spatial resolution of the temperature sensor 161 is thereby preferably adapted to the spatial resolution of the coater 142. For example, the resolution of the temperature sensor 161 may correspond to the resolution of the coater 142.

In an exemplary embodiment, the temperature sensor 161 is configured to respectively detect a temperature measurement value 202 with regard to the temperature of the recording medium 120 for a temperature segment of the recording medium 120. The temperature data may then have temperature measurement values 202 for a plurality of temperature segments of the recording medium 120. A temperature segment may thereby include one or more dots in the width direction 2 and/or one or more dots in the transport direction 1. For example, a temperature segment may have an extent of 1 inch or less in the width direction 2 and/or in the transport direction 1.

Within the scope of the method 300, a relative movement along the transport direction 1 may be produced between the temperature sensor 161 and the coater 142 (and the print group 140) on the one side and the recording medium 120 on the other side. In particular, as presented in conjunction with FIG. 1, the recording medium 120 may be directed with a defined transport velocity past the temperature sensor 161 and the coater 142 (and the print group 140). The transport velocity of the recording medium 120 is thereby proportion to or corresponds to the print speed of the printing device 100. The temperature sensor 161 may be configured to detect temperature data that include a plurality of temperature measurement values 202 for a corresponding plurality of (temperature) segments of the recording medium 120 along the width direction 2, orthogonal to the transport direction 1. The temperature sensor 161 may thereby be configured to essentially simultaneously detect at least one respective temperature measurement value 202 for each (temperature) segment along the width direction 2.

Furthermore, in an exemplary embodiment, the temperature sensor 161 may be configured to repeatedly, in particular periodically, detect corresponding temperature measurement values 202 for a sequence of (temperature) segments along the transport direction 1. The resolution along the transport direction 1 thereby typically depends on the transport velocity (and typically decreases with increasing transport velocity).

In an exemplary embodiment, a temperature sensor 161 is configured to determine temperature data that includes temperature measurement values 202 with regard to the temperature of the recording medium 120, in particular the surface of the recording medium 120, with a defined resolution in the width direction 2 and/or a defined resolution in the transport direction 1. The temperature data may thus indicate the spatial distribution 201 of the temperature along the surface of the recording medium 120 (similar to a temperature image).

In an exemplary embodiment, the method 300 also includes the setting 302 of the property and/or the quantity of the coating substance that is applied onto the recording medium 120 depending on the (spatially resolved) temperature data. In particular, a property and/or the quantity of the coating substance that is applied onto at least one defined coating segment of the recording medium 120 may thereby be set depending on the temperature data for at least one defined temperature segment, wherein the defined temperature segment and the defined coating segment at least partially intersect or overlap. In other words, a property and/or the quantity of the coating substance for a defined segment may be set and/or adapted depending on the temperature data for this segment of the recording medium 120.

Method 300 according to one or more exemplary embodiments includes the application of the coating substance onto the recording medium 120 depending on (spatially resolved) temperature data with regard to the temperature of the surface of a recording medium 120, in preparation for printing of a print image. The quality of the print image may be increased via the temperature-dependent adaptation of a property and/or the quantity of the coating substance, in particular given the presence of an inhomogeneous curve or an inhomogeneous distribution 201 of the temperature of the recording medium 120.

As was already presented above, the temperature data may indicate the curve 201 of the temperature of the recording medium 120 along at least one propagation direction of the recording medium 120. The propagation direction may thereby correspond to the width direction 2 and/or the transport direction 1. The temperature data may thereby indicate the curve 201 of the temperature for a plurality of (temperature) segments along the one or more propagation directions. The curve 201 of the temperature may be described by the plurality of temperature measurement values 202 for the corresponding plurality of (temperature) segments.

A property and/or the quantity of the coating substance may then be adapted along the propagation direction depending on the temperature data. In particular, a property and/or the quantity of the coating substance may be set or adapted for the plurality of segments of the recording medium 120 along the one or more propagation directions, depending on the corresponding plurality of temperature measurement values 202. In other words, a temperature-dependent variation of a property and/or the quantity of the applied coating substance may take place along the one or more propagation directions. The effects of inhomogeneities of the temperature of the surface of a recording medium 120 may thus be at least partially compensated for with regard to the print quality.

Characteristic data may be provided, wherein the characteristic data respectively indicate a property and/or the quantity of the coating substance to be applied for a plurality of different temperatures of the recording medium 120. The characteristic data may thereby have been determined in advance, within the scope of tests. In particular, within the scope of tests it may be determined what property or composition and/or what quantity of coating substance enables an optimally good print quality at a defined temperature of the recording medium 120.

In an exemplary embodiment, to determine the characteristic data, a recording medium 120 may be coated with coating substance at a defined temperature. One or more properties and/or the quantity of the coating substance may thereby be varied. The combination of one or more properties and the quantity of the coating substance for which an optimally high, in particular optimal print quality is achieved may then be selected on the basis of the sensor data of the sensor 150. The process may be performed accordingly for a plurality of different temperatures in order to determine the characteristic data.

In an exemplary embodiment, within the scope of the method 300, meaning given a running printing process, the property and/or the quantity of the coating substance may then be set depending on the characteristic data. The print quality may thus be further increased. In particular, the optimal property and/or the quantity of coating substance may respectively be reliably determined.

In an exemplary embodiment, the property and/or the quantity of the coating substance to be applied depends on the type of recording medium 120 that is to be printed to. Different characteristic data may be provided for different types of recording media 120 and be used within the scope of the method 300. In particular, the type of the recording medium 120 that is to be printed to may be determined, and the characteristic data may be selected depending on the determined type. The print quality may thus be further increased.

In an exemplary embodiment, as presented above, the temperature sensor 161 is configured to detect and provide a two-dimensional (2D) distribution 201 of the temperature of the surface of a recording medium 120 (for example by means of an infrared (IR) thermal camera). For a plurality of partial regions or segments 203 (for example for individual dots or for groups of dots) of the surface of the recording medium 120 that is to be printed to, the distribution 201 (in particular the temperature image or thermal image) may indicate the respective (possibly average) temperature present there. The temperature, in particular the measurement value 202 of the temperature, may thereby be illustrated via greyscale values 204, for example, as presented by way of example in FIG. 2*b*. The temperature or the corresponding greyscale values 204 for the different segments 203 may then be translated via the characteristic data (for example via a lookup table) into the property and/or the quantity of the coating substance to be applied. In particular, a 2D image with greyscale values 204 may be provided, wherein the greyscale values 204 for the different segments 203 of the surface of the recording medium 120 indicate the respective quantity of coating substance that is to be applied. The 2D image with greyscale values 204 may then be translated into a format (for example a PDF format or a format that is otherwise printable for the printing device 100) with which the coater 142 is controlled. The 2D image with greyscale values 204 may thus be printed onto the surface of the recording medium 120 by the coater 142 with coating substance. The respective required quantity of coating substance may thus be reliably and precisely applied onto the different segments 203 of the surface of the recording medium 120.

In an exemplary embodiment, the method 300 includes the determination of velocity data with regard to a print speed and/or a transport velocity with which the print image is printed on the recording medium 120 and/or with which the recording medium 120 is conveyed from the coater 142 to the print group 140. In an exemplary embodiment, a property and/or the quantity of the coating substance may then be set depending on the speed data. In particular, different characteristic data may be provided and used for different print speeds and/or transport velocities. Typically, the duration between the application of the coating substance and the printing of the print image changes due to the change of the print speed and/or the transport velocity. This typically influences the state of the coating substance upon reaching the print group 140, and thus also the respective optimal composition and/or quantity of the coating substance that is applied on the recording medium 120 in the coater 142. The print quality may thus be further increased by taking into account the print speed and/or the transport velocity.

In an exemplary embodiment, the method 300 includes the interpolation of the plurality of temperature measurement values 202 in a propagation direction of the recording medium 120 (for example in the width direction 2 and/or in the transport direction 1). An interpolated curve of the temperature along the propagation direction may be determined via the interpolation. For example, the interpolation may take place by determining a sliding mean value and/or via the use of a low pass filter. The size of a coating segment may be smaller than the size of a temperature segment. In other words, the spatial resolution of the coater 142 may be higher than the spatial resolution of the temperature sensor 161. The determination of an interpolated curve of the temperature nevertheless enables temperature values for the individual coating segments to be determined precisely.

In an exemplary embodiment, a property and/or the quantity of the coating substance to be applied along the propagation direction of the recording medium 120 (for example in the width direction 2 and/or in the transport direction 1) may then be set on the basis of the interpolated curve of the temperature. In particular, a property and/or the quantity of the coating substance may be determined for at least one coating segment on the basis of the interpolated temperature value for this segment. A precise setting of a property and/or the quantity of the coating substance to be applied is enabled via the use of the interpolation, even given a relatively low spatial resolution of the temperature measurement values.

The (coating) segments of the recording medium 120 along the width direction 2 might at least partially have a different length along the width direction 2. The plurality of (coating) segments of the recording medium 120 along the width direction 2 may extend from a first edge, across a middle, up to a second edge of the recording medium 120. The (coating) segments at the first edge and at the second edge of the recording medium 120 may then exhibit a shorter length along the width direction 2 than a (coating) segment in the middle of the recording medium 120.

In an exemplary embodiment, the spatial resolution with which a property and/or the quantity of the coating substance is set and/or with which the temperature data are acquired may thus be varied along the surface of the recording medium 120. In particular, it may thereby be taken into account that the magnitude of the changes of the temperature typically increases toward the edges of the recording medium 120. The print quality may be particularly efficiently increased via a spatial adaptation of the resolution of the coating segments and/or temperature segments.

In an exemplary embodiment, as has already been presented above, the temperature data may be acquired repeatedly, in particular periodically, for different segments of the recording medium 120 along the transport direction 1. A property and/or the quantity of the coating substance to be applied may then the set repeatedly, in particular periodically, for the different segments of the recording medium 120 on the basis of the respective temperature data. A setting and/or adaptation of a property and/or the quantity of the coating substance to be applied may thus take place quasi-continuously during a printing process (for successive blocks of lines of the print image). A high print quality may thus be maintained within the scope of a printing process.

Furthermore, a controller 101 for a printing device 100 is described in this document. The printing device 100 comprises a coater 142 that is configured to apply a coating substance onto the recording medium 120 during a printing process in preparation for the printing of a print image onto said recording medium 120. Furthermore, the printing device 100 comprises a print group 140 that is configured to print the print image onto the coated recording medium 120.

In an exemplary embodiment, the controller 101 is configured to determine (spatially resolved) temperature data with regard to the temperature of the recording medium 120. Furthermore, the controller 101 is configured to determine a property and/or the quantity of the coating substance depending on the temperature data. In an exemplary embodiment, the controller 101 is also configured to induce or otherwise control the coater 142 to apply a coating substance with the determined property and/or in the determined quantity onto the recording medium 120.

Moreover, a printing device 100, in particular an inkjet printing device 100, that comprises the controller 101, is described in this document.

Advantageously, according to one or more exemplary embodiments of the present disclosure, a uniformly high print quality may be produced even given an inhomogeneous distribution 201 of the temperature of a recording medium 120. Furthermore, the total quantity of coating substance that is applied onto a recording medium 120 may be reduced by taking into account the temperature of a recording medium 120. Deformations of the recording medium 120 as a result of a printing process may thus be reduced.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. A circuit includes an analog circuit, a digital circuit, state machine logic, other structural electronic hardware, or a combination thereof. A processor includes a microprocessor, a digital signal processor (DSP), central processing unit (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 transport direction
2 width direction
21, 22 nozzle (ink)
31, 32 column (of the print image)
41, 42 nozzle (coating substance)
51, 52 column (of the coating image)
100 printing device
101 controller
102 print bar
103 print head (ink)
120 recording medium
140 print group
142 coater
143 print head (coating substance)
150 sensor
161 temperature sensor
170 fixer
201 curve of the temperature
202 temperature measurement values
203 segment (recording medium)
300 method to set a property and/or the quantity of the coating substance
301-302 method operations

The invention claimed is:

1. A method for setting a property and/or quantity of a coating substance applied onto a recording medium during a printing process in preparation for the printing of a print image, the method comprising:

determining spatially resolved temperature data corresponding to a temperature of the recording medium; and setting the property and/or the quantity of the coating substance applied onto the recording medium based on the temperature data.

2. The method according to claim 1, wherein:

the temperature data indicates values of the temperature of the recording medium along a propagation direction of the recording medium; and the property and/or the quantity of the coating substance are adapted based on the temperature data along the propagation direction.

3. The method according to claim 1, wherein:

the property and/or the quantity of the coating substance are set based on characteristic data; and the characteristic data for a plurality of different temperatures of the recording medium respectively indicate the property and/or the quantity of the coating substance to be applied.

4. The method according to claim 1, further comprising:

producing a relative movement along a transport direction between a temperature sensor and a coater located on one side of the recording medium and the recording medium, wherein:

the temperature sensor is configured to detect the temperature of the recoding medium, the coater is configured to apply the coating substance onto the recording medium, the temperature data includes a plurality of temperature measurement values corresponding to a plurality of segments of the recording medium along a width direction orthogonal to the transport direction, and the property and/or the quantity of the coating substance for the plurality of segments of the recording medium are set based on the corresponding plurality of temperature measurement values.

5. The method according to claim 4, wherein:

the plurality of segments of the recording medium along the width direction at least in part exhibit a different length along the width direction; and/or the plurality of segments of the recording medium extend along the width direction from a first edge, across a middle, up to a second edge of the recording medium; and segments of the plurality of segments at the first edge and at the second edge of the recording medium exhibit a shorter length along the width direction than a segment of the plurality of segments in the middle of the recording medium.

6. The method according to claim 4, further comprising:

interpolating the plurality of temperature measurement values to determine interpolated values of the temperature along the width direction, wherein the property and/or the quantity of the coating substance to be applied are set along the width direction based on the interpolated values of the temperature.

7. The method according to claim 6, wherein:

the plurality of segments of the recording medium along the width direction at least in part exhibit a different length along the width direction; and/or the plurality of segments of the recording medium extend along the width direction from a first edge, across a middle, up to a second edge of the recording medium; and segments of the plurality of segments at the first edge and at the second edge of the recording medium exhibit a shorter length along the width direction than a segment of the plurality of segments in the middle of the recording medium.

8. The method according to claim 1, wherein:

the temperature data are repeatedly and periodically acquired for different segments of the recording medium along the transport direction; and the property and/or the quantity of the coating substance to be applied are set for the different segments of the recording medium based on the respective temperature data.

9. The method according to claim 1, further comprising:

determining speed data corresponding to a print speed with which the print image is printed onto the recording medium, wherein the property and/or the quantity of the coating substance are set based on the speed data.

10. The method according to claim 1, wherein the property of the coating substance comprises:

an active substance of the coating substance; and/or a concentration of the active substance within the coating substance.

11. A non-transitory computer-readable storage medium with an executable program stored thereon, wherein, when executed, the program instructs a processor to perform the method of claim 1.

12. A controller for a printing device having a coater configured to apply a coating substance onto a recording medium during a printing process in preparation for printing of a print image onto the recording medium, the controller comprising:

an interface; and processor circuitry that is configured to:

determine spatially resolved temperature data corresponding to a temperature of the recording medium, the temperature provided to the processor circuitry via the interface;

determine a property and/or a quantity of the coating substance based on the temperature data; and induce the coater to apply coating substance onto the recording medium with the determined property and/or in the determined quantity.

13. The controller according to claim 12, wherein:

the temperature data includes a plurality of temperature measurement values corresponding to a plurality of segments of the recording medium along a width direction orthogonal to the transport direction, and the controller is configured to set the property and/or the quantity of the coating substance for the plurality of segments of the recording medium based on the corresponding plurality of temperature measurement values.

14. The controller according to claim 13, wherein the controller is configured to receive the temperature of the recording medium from a sensor via the interface, the sensor being configured to detect the temperature of the recording medium.

15. A printer configured to print a print image onto a recording medium, comprising a coater configured to apply a coating substance onto the recording medium;

a sensor configured to detect a temperature of the recording medium; and a controller configured to:

determine spatially resolved temperature data corresponding to the temperature of the recording medium;

determine a property and/or a quantity of the coating substance based on the temperature data; and control the coater to apply coating substance onto the recording medium with the determined property and/or in the determined quantity.

* * * * *